United States Patent [19]

Nakagawa et al.

[11] 4,281,222

[45] Jul. 28, 1981

[54] MINIATURIZED UNIDIRECTIONAL ELECTRET MICROPHONE

[75] Inventors: Sadayoshi Nakagawa; Mitsuharu Shinohara, both of Fukuoka, Japan

[73] Assignee: Hosiden Electronics Co., Ltd., Osaka, Japan

[21] Appl. No.: 77,702

[22] Filed: Sep. 21, 1979

[30] Foreign Application Priority Data

Sep. 30, 1978 [JP] Japan ..... 53-135215[U]

[51] Int. Cl.[3] ..... H04R 19/04

[52] U.S. Cl. ..... 179/111 E; 179/110 A

[58] Field of Search ..... 179/111 R, 111 E, 121 R, 179/121 D, 110 R, 110 A, 110 B, 110 C, 110 D, 110 E, 110 F, 107 R, 107 E, 107 FD, 107 BC, 107 H, 107 S, 179

[56] References Cited

U.S. PATENT DOCUMENTS

| | | | |
|---|---|---|---|
| Re. 28,420 | 5/1975 | Murphy | 179/111 E |
| 4,063,049 | 12/1977 | Pipitone et al. | 179/110 A |
| 4,081,628 | 3/1978 | Neusel | 179/110 A |

FOREIGN PATENT DOCUMENTS

| | | | |
|---|---|---|---|
| 2906497 | 8/1979 | Fed. Rep. of Germany | 179/111 E |

*Primary Examiner*—Thomas A. Robinson

*Attorney, Agent, or Firm*—Pollock, Vande Sande and Priddy

[57] ABSTRACT

An electret diaphragm is housed in a case, a back electrode is disposed opposite the back of the electret diaphragm, a damper cloth is disposed in contact with the back of the back electrode, and a terminal plate is placed behind the damper cloth and connected with the back electrode. The back electrode, the damper cloth and the terminal plate are held by a tubular back electrode holder. The back of the back electrode holder is closed by a printed circuit board to define a rear compartment in the back electrode holder, and an impedance converter is disposed in the rear compartment. A sound hole is made for intercommunication of the rear compartment with the outside to achieve unidirectional directivity.

7 Claims, 5 Drawing Figures

MINIATURIZED UNIDIRECTIONAL ELECTRET MICROPHONE

BACKGROUND OF THE INVENTION

This invention relates to a miniaturized unidirectional electret microphone which employs an electret as a diaphragm and has a unidirectional characteristic.

In a conventional unidirectional electret microphone, a diaphragm, a back electrode and a back electrode holder are formed as a diaphragm unit, and an impedance converter for converting the microphone output into a low-impedance output is housed in a rear compartment to form an impedance converter unit; and the diaphragm unit and the converter unit are disposed in a case in its axial direction and fixed to each other. Since the diaphragm unit and the impedance converter unit thus separately prepared are combined, the conventional electret microphone has the defect that the length in its axial direction, that is the thickness, is large. The combination of such separate units calls for many parts, resulting in increased manufacturing cost. Further, the directional characteristic of the microphone is adjusted before the diaphragm unit is assembled with the impedance converter unit; but, for re-adjustment of the directional characteristic after assembling, it is necessary to disassemble the diaphragm unit from the case, and this is very troublesome.

An object of this invention is to provide a unidirectional electret microphone which can be reduced in thickness.

Another object of this invention is to provide a unidirectional electret microphone which is small in the number of parts used, easy to assemble and hence can be produced at low cost.

Another object of this invention is to provide a unidirectional electret microphone which permits easy re-adjustment of its directional characteristic.

Still another object of this invention is to provide a unidirectional electret microphone whose parts are mostly in common to a non-directional electret microphone.

SUMMARY OF THE INVENTION

In accordance with the present invention, a tubular back electrode holder is provided, and its front end portion is formed as a holding portion for holding a terminal plate, a damper cloth and a back electrode which are sequentially disposed one on another. The rear open end of the back electrode holder is closed by a printed circuit board to define a rear compartment in the back electrode holder for housing an impedance converter. The rear compartment communicates acoustically with the back side of an electret diaphragm through a hole or a slit in the terminal plate, the damper cloth and a sound hole in the back electrode. The electret diaphragm, the back electrode holder and the printed circuit board are housed in a case. The rear compartment communicates with the outside through sound holes, so that a sound reaching the back of the electret diaphragm from the outside through the rear compartment and a sound reaching the front of the electret diaphragm from in front are properly selected in magnitude to achieve unidirectional directivity.

The sound holes for intercommunication of the rear compartment with the outside may be made in the printed circuit board or in the peripheral walls of the back electrode holder and the case in alignment with each other. A ring-shaped washer of an elastic material can be disposed between the outer peripheral surface of the damper cloth and the inner peripheral surface of the back electrode holder, with both sides of the washer being in close contact with the back electrode and the terminal plate respectively, thereby to prevent a sound from escaping from between the damper cloth and the electrode or the terminal plate. This sound escape can also be prevented by closely contacting the peripheral surface of the back electrode and the inner peripheral surface of the back electrode holder.

DESCRIPTION OF THE PREFERRED EMBODIMENTS

Figure 1:
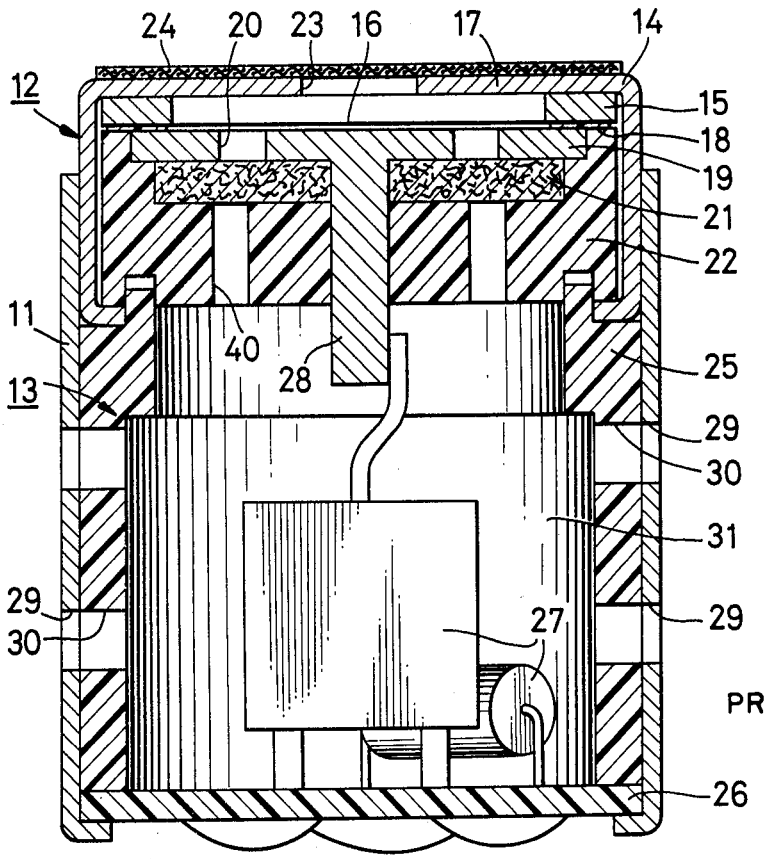
FIG. 1 is a cross-sectional view showing a conventional unidirectional electret microphone.

To facilitate a better understanding of the present invention, a description will be given first of a conventional unidirectional electret microphone in connection with FIG. 1.

In a cylindrical case 11, there are arranged, in its axial direction, an electret diaphragm unit 12 and an impedance conversion unit 13. The electret diaphragm unit 12 is disposed in a capsule 14, and an electret diaphragm 16 adhesively attached to a ring 15 is placed in adjacent but spaced relation to a front panel 17 of the capsule 14 on the side of the ring 15. A back electrode 19 is disposed opposite the electret diaphragm 16 with a ring-shaped spacer 18 held therebetween, the back electrode 19 having formed therethrough sound holes 20. At the back of the electrode 19, there is disposed in contact therewith a damper cloth 21. The damper cloth 21 and the back electrode 19 are held together by a back electrode holder 22 made of a synthetic resin. The rear end portion of the capsule 14 is bent inwardly to be pressed against the back of the back electrode holder 22, fixing the electret diaphragm unit 12 in its entirety. A sheet of cloth 24 is attached to the front panel 17 of the capsule 14 to cover a central opening 23 formed in the front panel 17. The back electrode holder 22 has formed therein holes 40 in opposing relation to the damper cloth 21.

In the impedance conversion unit 13, a tubular holder 25 is disposed on the inside of the case 11 coaxially therewith, the front end portion of the holder 25 being engaged with the electret diaphragm unit 12 and the rear open end portion being closed by a printed circuit board 26. On the printed circuit board 26 there is formed an impedance converter 27, which is housed in the holder 25. At the axial position of the electret diaphragm unit 12, the back electrode 19 partly projects down into the impedance conversion unit 13 to provide a terminal 28, which is connected with input leads of the impedance converter 27. The case 11 has bored therethrough sound holes 29, and in alignment therewith, holes 30 are also formed in the holder 25, permitting intercommunication between a back compartment 31 defined by the holder 25 and the outside. Consequently, sounds entering into the back compartment 31 from the outside through the sound holes 30 also reach the electret diaphragm 16 from behind through the holes 40, the damper cloth 21 and the sound holes 20. The magnitudes of the sounds reaching the electret diaphragm 16 both from behind and from in front are selected to bear a proper relationship to each other, thereby achieving the unidirectionality directivity.

As described above, in the prior art unidirectional electret microphone, the electret diaphragm unit 12 and the impedance conversion unit 13, prepared separately of each other, are housed in the case 11, so that the length of the microphone in its axial direction is inevitably large. On top of that, the electret diaphragm unit 12 is incorporated in the case 11 after its directivity is measured and regulated, but when the directivity varies after assembling, it is necessary to disassemble the electret diaphragm unit 12 from the case 11 for re-adjustment.

Figure 2:
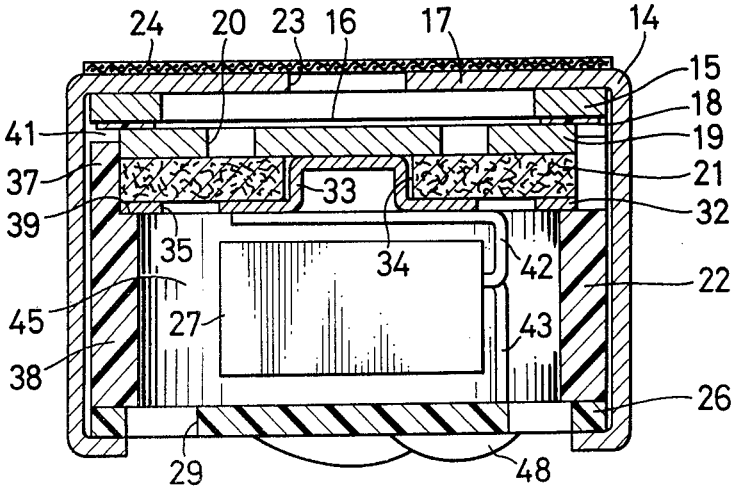
PRIOR ART FIG. 2
FIG. 2 is a cross-sectional view, similar to FIG. 1, illustrating an embodiment of the electret microphone of the present invention.

FIG. 2 shows an embodiment of the electret microphone of the present invention. In a cylindrical metal case 14 having its front end closed, there is disposed an electret diaphragm 16 in adjacent but spaced relation to a front end plate 17 of the case 14. The electret diaphragm 16 is a film of a synthetic resinous material polarized in the direction of its thickness and has a metal layer deposited on one surface of the film. The electret diaphragm 16 has the metal layer attached to a metal ring 15, which is, in turn, held in contact with the front end plate 17 of the case 14. A back electrode 19 is disposed opposite the electret diaphragm 16 with a ring-shaped spacer 18 held therebetween, and behind the back electrode 19, a damper cloth 21 as of felt, non-woven cloth, air-permeable porous urethane or like material is disposed. The back electrode 19 has bored therethrough sound holes 20.

In the present invention, a terminal plate 32, which has a centrally-disposed projection 33, is placed behind the damper cloth 21 in contact therewith, and the projection 33 is snugly fitted in a through hole 34 formed in the damper cloth 21 centrally thereof and is held in contact with the back electrode 19 by means such as spot welding. The terminal plate 32 has a plurality of holes 35 distributed throughout it. The back electrode 19, the damper cloth 21 and the terminal plate 32 are held together by a back electrode holder 22.

Figure 3:
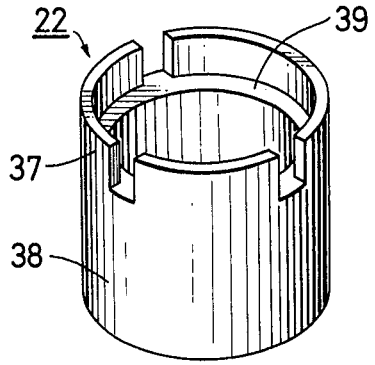
FIG. 3 is a perspective view showing a back electrode holder 22 used in the embodiment of FIG. 2.

The back electrode holder 22 is a cylindrical member made of a synthetic resinous material, and its front end portion is made thin on the inside thereof to have a stepped portion 39, forming a holding portion 37 (see FIG. 3). In the holding portion 37, the terminal plate 32, the damper cloth 21 and the back electrode 19 are sequentially placed one on another while being held on the stepped portion 39. In this case, the front of the back electrode 19 projects out forwardly of the holding portion 37 to define an air gap 41 between the spacer 18 and the front edge of the holding portion 37, as shown in FIG. 2.

A printed circuit board 26 is disposed in contact with the rear end face of the back electrode holder 22. The rear end portion of the case 14 is bent inwardly to be staked against the back of the printed circuit board 26 so that the parts in the case 14 are fixedly urged against the front end plate 17. In the case 14, an impedance converter element 27 is mounted on the printed circuit board 26, and an input terminal 42 of the impedance converter element 27 is connected with the terminal plate 32. The impedance converter element 27 is operative to convert a high-impedance input into a low-impedance output and is usually constituted as a semiconductor integrated circuit in which a field effect transistor and a resistance element are interconnected in the source follower manner. A terminal lead-out portion of the impedance converter element 27 faces towards the inner surface of the back electrode holder 22, and the input terminal 42, an output terminal 43 and a grounding terminal 44 (not shown in FIG. 2) are bent forwardly and backwardly of the impedance converter element 27, and the terminals 43 and 44 are connected with the printed circuit board 26.

The back electrode holder 22 defines a rear compartment 45 in the case 14, and the rear compartment 45 is made to communicate with the outside. In FIG. 2, the printed circuit board 26 has formed therein a plurality of sound holes 29. Accordingly, sounds entering into the back compartment 45 from the outside through the sound holes 29 reach the back of the electret diaphragm 16 by passing through the holes 35 and the damper cloth 21, and the sounds reaching the electret diaphragm 16 both from behind and from in front are made to bear a suitable relationship to each other in terms of magnitude to achieve the unidirectional directivity. On the back of the printed circuit board 26, there are deposited solder bodies 48 respectively corresponding to the terminals.

Such an electret microphone of this invention differs from the conventional electret microphone of FIG. 1 in that the electret diaphragm 16, the back electrode 19, the back electrode holder 22 and the impedance converter element 27 are encased in the case 14 and formed as a unitary structure without the necessity of forming a separate electret diaphragm unit; consequently the electret microphone of this invention can be reduced in size in its axial direction. With the arrangement of this invention, the thickness of the electret microphone could be reduced about by half as compared with prior art electret microphones. Further, the electret microphone of the present invention requires fewer parts and steps in its manufacture and hence is less expensive.

Moreover, by selecting the degree of staking the rear end portion of the case 14, the gap 41 is made large or small to thereby permit adjustment of the compression degree of the damper cloth 21; as a consequence, the magnitude of the sound reaching the electret diaphragm 16 from behind passing through the damper cloth 21 can be adjusted, permitting adjustment of the directional characteristic of the electret microphone. Accordingly, for adjustment of its directional characteristic, the electret microphone of this invention does not require the troublesome operation of disassembling the electret diaphragm unit from the case as is involved in the conventional electret microphone of FIG. 1.

Further, by sealing the rear compartment 45 with a printed circuit board 26 having no sound holes 29, a non-directional microphone can be obtained; therefore, almost all the parts can be used in common for both of the unidirectional and non-directional microphones. The demand for a unidirectional microphone is generally smaller than demand for a non-directional microphone, so that it is economically disadvantageous to use a large number of parts which are employed solely for a unidirectional microphone. However, the electret microphone of this invention can be produced using many of the same parts as those for the non-directional microphone, and hence can be obtained at low cost in this regard, too.

Figure 4:
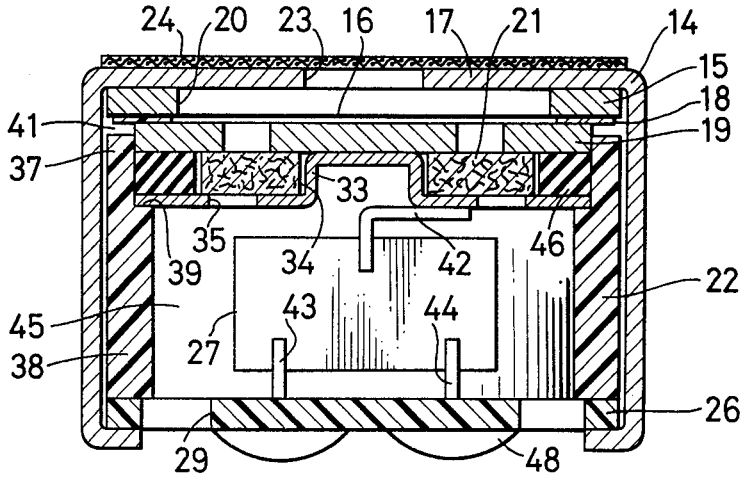
FIGS. 4 and 5 are cross-sectional views respectively illustrating other embodiments of the unidirectional electret microphone of the present invention.

As shown in FIG. 4 in which parts corresponding to those in FIG. 2 are identified by the same reference numerals, it is also possible to interpose a ring-shaped washer 46 between the outer peripheral surface of the damper cloth 21 and the inner surface of the back holder 22 in contact with the back electrode 19 and the terminal plate 32. By closely contacting both end faces of the washer 36 with the back electrode 19 and the terminal plate 32 respectively, sounds can be prevented from escaping from between the back electrode 19 and the damper cloth 21 or from between the damper cloth 21 and the terminal plate 32. Especially when the clamping force for the damper cloth 21 is weak, or when the damper cloth 21 has a small thickness or a rough surface, there is danger of sounds escaping from between the back electrode and the terminal plate. With the use of the washer 46 of rubber or like an elastic material, however, it is possible to prevent such escape of sounds. By closely contacting the inner peripheral surface of the holding portion 37 and the peripheral surface of the back electrode 19 with each other, and the outer peripheral surface of the back electrode holder 22 and the peripheral surface of the case 14 with each other, sounds can similarly be prevented from escaping from between the damper cloth 21 and the back electrode 19 or the terminal plate 32 even if the washer 46 is not employed.

Figure 5:
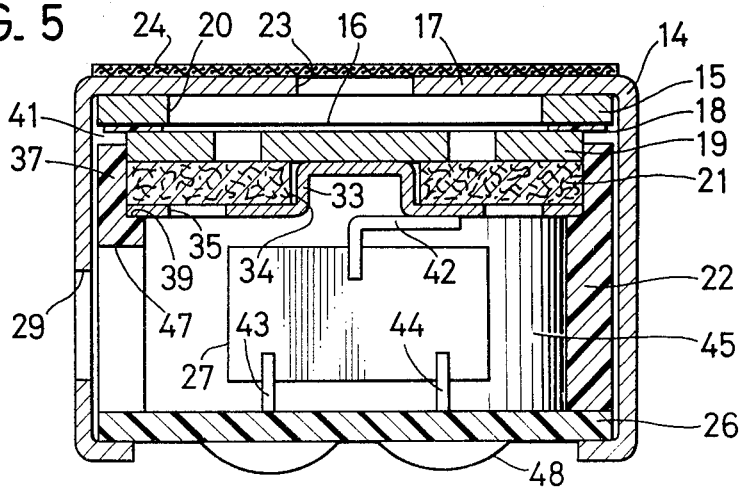

Sounds from the outside may be introduced into the rear compartment 45 not only from the side of the back of the back electrode holder 22 but also from the side of its periphery, as shown in FIG. 5. In FIG. 5, the sound holes 29 are not formed in the printed circuit board 26, but instead, a sound hole 47 is bored in the peripheral wall of the back electrode holder 22 defining the rear compartment 45, and a sound hole 29 is made in the case 14 in alignment with the sound hole 47, so that sounds from the outside are introduced into the rear compartment 45 through the sound holes 29 and 47.

The structures of FIGS. 2 and 4 have advantages over the structure of FIG. 5 in the following respects: The structures of FIGS. 2 and 4 do not require positioning of the sound holes 29 and 47 in alignment with each other and hence permit easy assembling. Since the case 14 has no holes, its mechanical strength is not impaired; consequently, the case 14 is not likely to be deformed when staking its rear end portion. Similarly, since the sound hole 47 is not made in the back electrode holder 22, its mechanical strength is not impaired. Further, the case 14 is sometimes inserted into a cylindrical attachment of rubber; in such a case, the structures of FIGS. 2 and 4 do not require making a hole in the attachment corresponding to the sound hole 29 nor do they require positioning the hole in alignment with the sound hole 29.

It will be apparent that many modifications and variations may be effected without departing from the scope of the novel concepts of this invention.

What is claimed is:

1. A miniaturized unidirectional electret microphone comprising:

a tubular case having at one end a front end plate formed integrally therewith, the front end plate having a hole therein for introducing sound into the case;

an electret diaphragm disposed in the case in opposing relation to the front end plate;

a back electrode disposed in the case in opposing relation to the electret diaphragm;

a damper cloth disposed in contact with the back of the back electrode, said damper cloth having a hole therein;

a terminal plate disposed behind the damper cloth, said terminal plate having a projection which is connected with said back electrode through said hole in the damper cloth;

a tubular back electrode holder disposed in the case coaxially therewith for holding the terminal plate, the damper cloth and the back electrode together;

a printed circuit board disposed at the back of the back electrode holder to close its rear open end, thereby to define a rear compartment in the back electrode holder;

an impedance converter formed on said printed circuit board in the rear compartment and connected with the terminal plate for converting an input into a low-impedance output; and a sound hole for intercommunicating the rear compartment and the outside of the case and operative to introduce sound from the outside of the case into the said rear compartment.

2. A miniaturized unidirectional electret microphone according to claim 1, wherein the sound hole is made in the printed circuit board.

3. A miniaturized unidirectional electret microphone according to claim 1, wherein the sound hole is composed of a first sound hole in the peripheral wall of the back electrode holder in the part thereof forming the rear compartment, and a second sound hole in the case in alignment with the first sound hole.

4. A miniaturized unidirectional electret microphone according to claim 1, wherein said hole in said damper cloth is centrally located therein, the terminal plate being disc-shaped and having at least one hole therein spaced laterally from said central hole in said damper cloth for introducing sound into the damper cloth from the rear compartment, said projection on said terminal plate being centrally-disposed thereon and extending forwardly of said disc-shaped plate for making electrical contact with the back electrode through said central hole in the damper cloth.

5. A miniaturized unidirectional electret microphone according to claim 1, which further comprises a ring-shaped washer of an elastic material disposed between the outer peripheral surface of the damper cloth and the inner peripheral surface of the back electrode holder and having its opposing sides in close contact with the back electrode and the terminal plate respectively.

6. A miniaturized unidirectional electret microphone according to claim 1, wherein the inner peripheral surface of the back electrode holder on the side of the electret diaphragm is partly cut out to form a stepped portion between a part of larger inner diameter and a part of smaller diameter, and wherein the terminal plate is held on the stepped portion.

7. A miniaturized unidirectional electret microphone according to claim 6, wherein the front surface of the back electrode held by the back electrode holder lies further to the side of the electret diaphragm than the end face of the back electrode holder on the side of the electret diaphragm.

* * * * *